US005471811A

United States Patent [19]

House et al.

[11] Patent Number: 5,471,811

[45] Date of Patent: Dec. 5, 1995

[54] COMBINATION TRAFFIC BARRIER AND RETAINING WALL AND METHOD OF CONSTRUCTION

[75] Inventors: Randall H. House, San Antonio; Johann H. Hofmann; Freddie C. Birck, both of Boerne, all of Tex.

[73] Assignee: Marylyn House, San Antonio, Tex.

[21] Appl. No.: 917,841

[22] Filed: Jul. 21, 1992

Related U.S. Application Data

[60] which is a continuation-in-part of Ser. No. 675,503, Mar. 26, 1991, abandoned, and Ser. No. 601,413, Oct. 22, 1990, Pat. No. 5,131,786, which is a continuation-in-part of Ser. No. 347,482, May 4, 1989, Pat. No. 4,964,750.

[51] Int. Cl.[6] ..... E04B 2/10

[52] U.S. Cl. ..... 52/745.1; 52/741.13; 52/747.12; 256/13.1; 256/19; 256/24

[58] Field of Search ..... 256/13.1, 19, 24, 256/25, 31, 73; 404/6–8; 52/609, 437, 438, 579, 574, 442, 742, 745.1, 745.13, 295, 259, 747; 405/262, 284, 285, 286, 287

[56] References Cited

U.S. PATENT DOCUMENTS

| | | | |
|---|---|---|---|
| 1,739,108 | 12/1929 | Weber . | |
| 1,933,483 | 10/1933 | Pennoyer . | |
| 1,943,800 | 1/1934 | Morrison . | |
| 2,129,369 | 9/1938 | Faber . | |
| 2,963,827 | 12/1960 | Ganton . | |
| 3,195,312 | 7/1965 | Rumsey | 52/742 |
| 3,678,815 | 7/1972 | Younker | 256/13.1 |
| 3,732,653 | 5/1973 | Pickett . | |
| 3,832,817 | 9/1974 | Martens . | |
| 3,906,687 | 9/1975 | Schupack | 52/745.13 |
| 3,991,532 | 11/1976 | Buxbom | 52/742 |
| 4,006,570 | 2/1977 | Stolz . | |
| 4,019,293 | 4/1977 | Armas . | |
| 4,050,254 | 9/1977 | Meheen et al. . | |
| 4,059,362 | 11/1977 | Smith | 404/6 |
| 4,111,401 | 9/1978 | Pickett . | |
| 4,193,584 | 3/1980 | Wieser . | |
| 4,214,411 | 7/1980 | Pickett . | |
| 4,260,296 | 4/1981 | Hilfiker | 404/7 |
| 4,324,508 | 4/1982 | Hilfiker | 405/258 |
| 4,336,675 | 6/1982 | Pereira | 52/437 |
| 4,435,106 | 3/1984 | Forster | 404/6 |
| 4,494,892 | 1/1985 | Wojciechowski . | |
| 4,496,264 | 1/1985 | Casey | 404/6 |
| 4,529,174 | 7/1985 | Pickett . | |
| 4,553,875 | 11/1985 | Casey | 404/6 |
| 4,558,850 | 12/1985 | Melfi . | |
| 4,605,336 | 8/1986 | Slaw, Sr. . | |
| 4,772,155 | 9/1988 | Dinitz | 404/6 |
| 4,806,044 | 2/1989 | Duckett | 404/6 |
| 4,917,543 | 4/1990 | Cole et al. . | |
| 4,957,395 | 9/1990 | Nelson . | |
| 4,961,293 | 10/1990 | House | 52/223.6 |
| 4,964,750 | 10/1990 | House et al. . | |
| 5,131,786 | 7/1992 | House . | |

FOREIGN PATENT DOCUMENTS

| | | | |
|---|---|---|---|
| 687605 | 4/1930 | France . | |
| 162636 | 7/1986 | Japan | 52/742 |
| 2071 | of 1907 | United Kingdom | 256/19 |
| 2183269 | 6/1987 | United Kingdom | 52/742 |

*Primary Examiner*—Randolph A. Reese
*Assistant Examiner*—Anthony Knight
*Attorney, Agent, or Firm*—Gunn, Lee & Miller

[57] ABSTRACT

This invention relates to a combination precast concrete traffic barrier element and a precast C-shaped retaining wall, and a method of constructing a traffic barrier using the element on the vertical face of the retaining wall. The barrier element is a profiled reinforced block of concrete having a bottom surface with a longitudinally extending channel therein. The traffic barrier element is supported on the retaining wall. U-shaped anchoring bars project from an interior portion of the traffic barrier element and from the top surface of the retaining wall to form an oval keyway the length of the longitudinal channel. A locking bar arrangement is inserted through the keyway in a locking relationship with the U-shaped anchoring bars. Concrete is then injected throughout the longitudinal channel and allowed to harden, thus providing a sealed and locked joint.

12 Claims, 7 Drawing Sheets

COMBINATION TRAFFIC BARRIER AND RETAINING WALL AND METHOD OF CONSTRUCTION

CROSS-REFERENCES TO RELATED APPLICATIONS

This is a continuation-in-part of application Ser. No. 07/601,413 filed Oct. 22, 1990, now U.S. Pat. No. 5,131,786, which was a continuation-in-part of application Ser. No. 07/347,482 filed May 4, 1989, now U.S. Pat. No. 4,964,750; this application is also a continuation-in-part of application Ser. No. 07/675,503 filed Mar. 26, 1991, now abandoned.

BACKGROUND OF THE INVENTION

1. Field of the Invention

This invention relates to precast traffic barriers and retaining walls for use in highway construction. More specifically, the present invention relates to a combination of a precast concrete traffic barrier and a precast retaining wall and a method of constructing the traffic barrier on the top face of the retaining wall.

Traffic barriers are used on roads to keep a moving vehicle from crossing into the path of oncoming traffic or from driving off the roadway. The traffic barrier is especially useful on elevated or split-level roadways, such as bridges, entrance ramps, or access roads to highways, to prevent a vehicle from driving off the road onto a lower level roadway. These elevated roads are often formed by cutting through a hill or by piling earth or soil onto metal reinforcements to form a laterally stabilized composite earth structure to support the road. Either method of construction may result in a wall face which needs to be supported by a retaining wall. If this retaining wall is close to the road surface there is a need for a traffic barrier which can be anchored on top of the retaining wall. The wall, of any height, defines a lengthwise horizontal beam for anchoring the barrier.

Retaining walls may be cast-in-place, built from blocks placed one on top of the other, or may be prefabricated panels. All retaining walls are designed to protect the earth slope from slides due to weather erosion.

Construction of a traffic barrier on top of and along a retaining wall may be cast-in-place so as to be an integral part of the retaining wall. However, this construction method requires forms to be constructed by workmen on scaffolding. Hand construction of the forms and pouring of concrete is slow and labor intensive. Thus, there is a need for a more efficient method of constructing a combination traffic barrier and retaining wall.

2. DESCRIPTION OF THE PRIOR ART

Basic traffic barriers separating two lines of vehicular traffic are not new in the art. U.S. Pat. No. 3,678,815 issued to Younker discloses a concrete traffic barrier which may be used in forming bridge guard rails, median barriers, and the like. The Younker barrier includes a pair of identically shaped shells which are bolted together leaving a void into which concrete is poured to form a core of solid material. U.S. Pat. No. 4,435,106 issued to Forster et al. discloses a traffic barrier which may be used to separate a roadway. The Forster traffic barrier may be cast-in-place through the use of forms to construct a solid concrete barrier which rises from the roadway edge outwardly first gently and then more strongly and then spaced below an overhanging guiding mechanism. A steep convex rise follows the gentle rise and transfers under the guiding mechanism into a flattened area.

Combining steel and concrete in a traffic barrier was disclosed in U.S. Pat. No. 4,496,264 issued to Casey. Casey discloses a barrier structure comprised of a number of spaced apart inline vertical I-beam sections embedded in a roadway and having secured to the I-beams a number of form plates having a pair of downwardly and outwardly diverging pair of legs and a pair of upwardly diverging extending arms. Reinforcing rods are extended through aligned holes in the plates and side panels are connected to the panels. Concrete is poured down through the open top of the structure completely encasing the I-beams, panels, and reinforcing rods. The concrete bonds the side panels and a capping piece is pressed down into the concrete to form the steel and concrete traffic barrier.

Constructing concrete traffic barriers with precast concrete was first patented by Smith in U.S. Pat. No. 4,059,362. Smith discloses a highway traffic barrier composed of precast, reinforced concrete barricades which are joined together. The alignment with each barricade is accomplished through the use of a horizontally and vertically tapered, vertical tongue-and-groove arrangement. This tongue-in-groove arrangement is molded onto the ends of each barricade with the wider portion of the taper at the bottom to facilitate the removal of one piece of the traffic barrier within an installation. The Smith barricade though is designed to be a highway median barrier and cannot be secured to a retaining wall.

A precast barrier design which can be used an retaining walls is disclosed in U.S. Pat. No. 4,494,892 issued to Wojciechowski. This design makes use of an interior channel of the barrier which directly mounts the top edge of the retaining wall to partially support the barrier element. Concrete fill must be used between the top edge of the wall face and the internal face of the channel to ensure that gaps are eliminated. If gaps were allowed to exist, then debris and water could penetrate through the gaps and accumulate behind the wall face. The projecting anchoring rods extend either transversely into a lateral cast in situ counter apron under the roadway surface or downwardly into the earthen support of the roadway. These projecting anchoring rods stiffen the barrier and wall while counterbalancing vehicle impact forces.

Another known precast traffic barrier is U.S. Pat. No. 4,348,133 issued to Trent disclosing a precast polymer concrete shell which is placed at the construction site then filled with hydraulic concrete or other ballast through filling holes on top of the shell. However, the shell cannot be placed on a retaining wall since the shell must be entirely placed on the road or bridge surface.

A method of joining precast concrete barriers to substantially flat roadway surfaces is disclosed in U.S. Pat. No. 4,605,336 issued to Slaw. This design uses a tunnel-like opening extending longitudinally through the bottom of the deck. The first part of the opening is comprised of an inwardly flaring void immediately followed by an outwardly flaring void. This sequence repeats itself throughout the length of the parapet. Parapet reinforcing bars are cast within the parapet and extend horizontally through each section of the inwardly flaring voids. U-shaped deck reinforcing bars are cast within the concrete deck and extend upwardly within each section of the outwardly flaring voids. A locking bar is inserted through the voids above the parapet reinforcing bars and below deck reinforcing bars. Pressure pumped concrete grout is then forced into grout inlet holes until the entire length of voids is filled with grout. One problem with this design is that it can only be used on a substantially flat roadway and the alignment of the precast barrier and roadway must be precise to insure that the U-shaped rods are inserted into outwardly flaring voids.

SUMMARY OF THE INVENTION

A combination precast concrete traffic barrier and precast C-shaped retaining wall comprised of a barrier element having a profiled inner face, a relatively unprofiled exterior face, a bottom surface having a longitudinally extending channel capable of receiving a retaining wall's top surface, upper U-shaped anchoring bars projecting from the barrier into the bottom surf ace's longitudinal channel, lower U-shaped anchoring bars projecting from the retaining wall's top surface into the bottom surface's longitudinal channel, an oval keyway the length of the longitudinal channel formed by the overlapping of the upper U-shaped anchoring bars and the lower U-shaped anchoring bars, and a locking bar arrangement inserted through the keyway in a locking relationship with the overlapping U-shaped anchoring bars. The C-shaped retaining wall has U-shaped flanges which when placed adjacent to a second C-shaped retaining wall forms a stay-in-place form for a structural column. The disclosed combination permits the use of precast concrete to form a traffic barrier for use upon a precast retaining wall capable of withstanding vehicular impact.

It is an object of the present invention to provide an efficient method of constructing a retaining wall and attaching a traffic barrier to the top face of a retaining wall without the need for direct contact between the barrier and retaining wall.

Another object of the invention is to provide a means of attaching a traffic barrier to the top face of a retaining wall without requiring precise alignment between the retaining wall and the traffic barrier.

A further object of the present invention is to provide a means of coupling precast traffic barriers to a retaining wall.

Still a further object of the present invention is to provide a means of rigidly connecting a traffic barrier to a retaining wall without the need for outwardly projecting support rods.

Additional advantages, objects and uses will be apparent from the description to those familiar with the relevant art.

The foregoing objectives are achieved in a combination precast traffic barrier and precast C-shaped retaining wall in which the barrier is reinforced with welded wire fabric and which has a longitudinal channel at its base so as to allow the traffic barrier to be supported on top of the C-shaped retaining wall. The traffic barrier and retaining wall have U-shaped anchoring rods meeting in an oval in the channel providing an interlocking mechanism when a locking U-shaped welded wire fabric is inserted through the oval throughout the length of the barrier.

DESCRIPTION OF THE PREFERRED EMBODIMENT

Applicant incorporates by reference, as if rewritten herein in their entirety, the entire disclosures of application Ser. No. 07/601,413 filed Oct. 22, 1990, now U.S. Pat. No. 5,131,786, which was a continuation-in-part of application Ser. No. 07/347,482 filed May 4, 1989, now U.S. Pat. No. 4,964,750, and application Ser. No. 07/675,503 filed Mar. 26, 1991.

Figure 1:
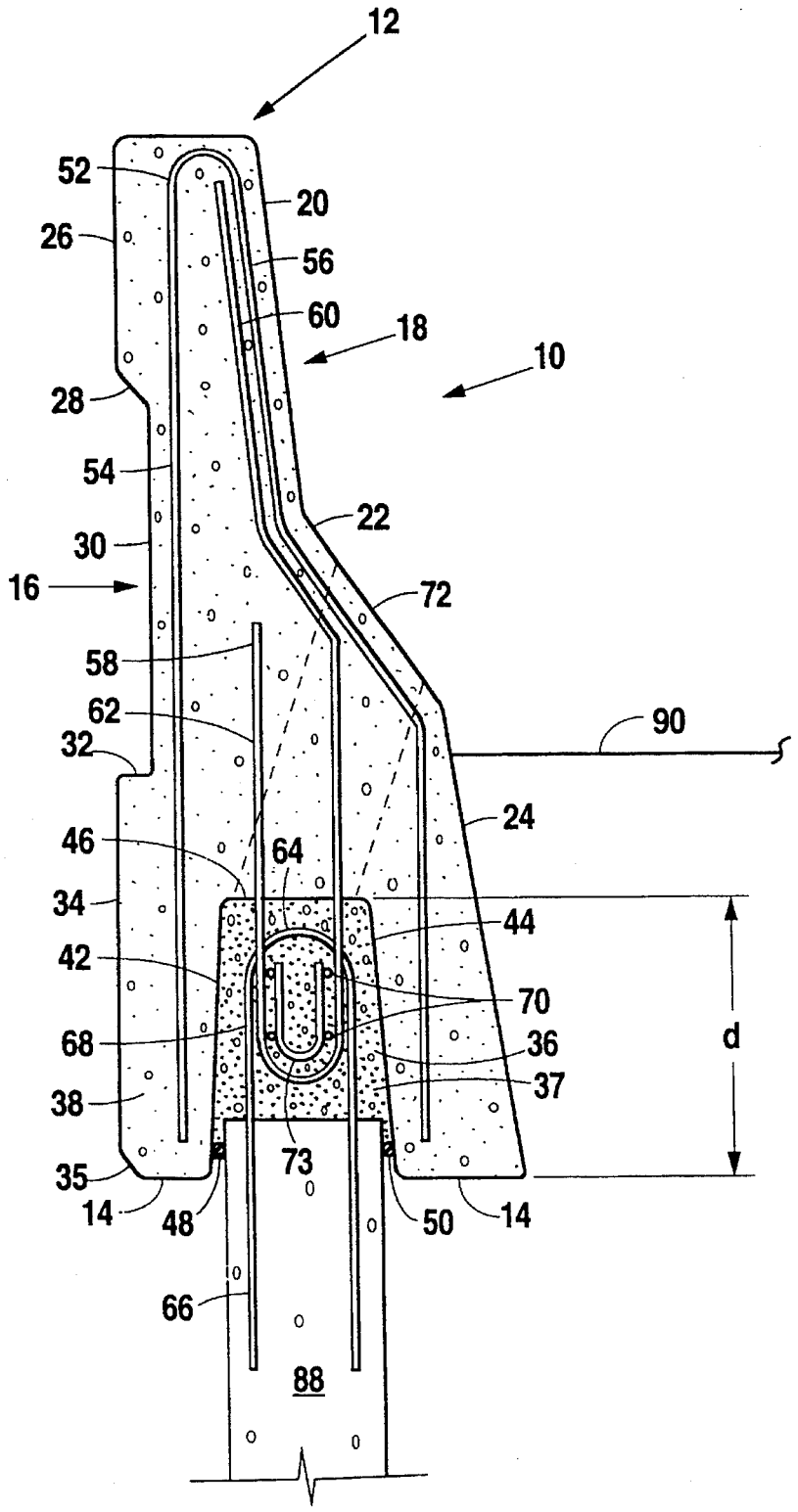
FIG. 1 is a cross-sectional view of one embodiment of a precast concrete traffic barrier element constructed in accordance with this disclosure.

With Reference to FIG. 1, one embodiment of the precast concrete traffic barrier element 10 according to the present invention includes an elongated block of precast concrete having a top surface 12, a bottom surface 14 and two sides 16 and 18.

One side 18 preferably has a cross-sectional New Jersey profile for deflecting or redirecting a moving vehicle back towards the traffic surface 90. The New Jersey profile includes an upper inclined surface 20 extending from the top surface 12 and sloping downwardly at a first acute angle with respect to a vertical plane. An intermediate inclined surface 22 extends from the upper inclined surface 20 and slopes downwardly at a second acute angle which is greater than the first angle. A lower inclined surface 24 extends between the intermediate inclined surface 22 and the bottom surface 14. The lower inclined surface 24 slopes downwardly at a third acute angle which is less than the second angle and more than the first angle. This profile is well reported in the literature.

A relatively unprofiled side 16, opposite from the profiled side 18, provides an ornamental aspect to the traffic barrier. The relatively unprofiled side has an upper vertical surface 26 extending from the top surface 20 and sloping downward at a vertical angle. An intermediate inclined surface 28 extends from the upper vertical surface 26 and slopes downwardly at an acute angle with respect to a vertical plane. An intermediate vertical surface 30 extends from the intermediate inclined surface 28 to a horizontal surface 32. The horizontal surface 32 extends from the intermediate vertical surface 30 to the lower vertical surface 34. A lower vertical surface 34 extends from the horizontal surface 32 to the chamfer surface 35. The chamfer surface 35 extends between the lower vertical surface 34 and the bottom surface 14.

The bottom surface 14 of the precast traffic barrier has a longitudinally extending channel 36 therein. The channel 36 has a significant depth d of approximately 15 inches but can vary from 4 inches to 48 inches depending on the specific requirements. Preferably, the channel 36 has a trapezoidal configuration with an internal face 46 which is parallel to the bottom surface 14. Two sidewalls 42, 44 of the channel 36 extend from the internal face 46 to the bottom surface 14. Preferably, the outer sidewall 42 diverges downwardly in a direction away from the profiled side 18 and the inner sidewall 44 diverges downwardly in an opposite direction away from the unprofiled side 16. As shown, the channel 36 is broader at the bottom for easy engagement.

The channel 36 divides the lower section of the concrete precast traffic barrier into two lips 38 and 40. The outer lip 38 is defined by the concrete between the lower vertical surface 34 of the unprofiled side 16 and the outer sidewall 42 of the channel 36. The inner lip 40 is defined by the concrete between the lower inclined surface 24 18 of the profiled side 18 and the inner sidewall 44 of the channel 36. The two lips flank the channel 36 for the full length of the barrier.

Embedded throughout the precast traffic barrier 10 is reinforcing welded wire fabric 52 to resist directly applied stresses to the precast concrete traffic barrier. The welded wire fabric 52 has an outer vertical section 54 embedded within the concrete adjacent to the unprofiled side 16 and an inner section 56 embedded within the concrete adjacent to the profiled side 18. The inner section 56 follows the slopes of the profiled side 18 at the upper inclined surface 20, intermediate inclined surface 22, and also the lower inclined surface 24.

Also embedded in the concrete barrier 10 are U-shaped reinforcing anchoring rods 58 to resist applied stresses at the channel 36. The U-shape opens upwardly. An upper U-shaped anchoring rod 58 has an inner inclined section 60 embedded within the concrete adjacent to the profiled side 18 and an outer vertical section 62 embedded within the concrete adjacent to the unprofiled side 16. The upper U-shaped anchoring rod 58 extends into the channel 36 to form an eyelet cooperative with a similar eyelet 64 with a lower U-shaped anchoring rod 66. The lower U-shaped anchoring rods 66 are embedded in the retaining wall 88. This U-shape opens downwardly. Preferably, there are a plurality of upper U-shaped anchoring rods 58 and a matching plurality of lower U-shaped anchoring rods 66 spaced evenly throughout the length of the barrier. Thus, the open channel encloses alternating eyelets; FIG. 1 shows the eyelets inscribing a large area for a lock to be described.

Viewing the channel 36 prior to filling with grout, an elongate rebar lock member is inserted from the end; that is, several rebars 70 form a lock equal to the barrier in length. The rebars 70 are formed into a beam by plural, spaced U-shaped cross bars 73. The beam is inserted into the channel 36, passes through every eyelet and fastens the barrier 10 to the supporting wall 88.

Inlet fill holes 72 extend from the intermediate inclined surface 22 of the profiled side 18 to the empty channel 36. The inlet fill holes 72 are used to pump cast-in-place concrete, grout, mortar or similar material into the channel 36 to fill the channel along this length of the barrier 10. Separately installed sealing material at 48 and 50 prevent the pumped in cast-in-place concrete, grout, mortar or similar material from escaping from the channel 36 during the pumping process. The sealing material 48 and 50 ideally is impregnated asphalt board, however alternative materials, including but not limited to elasticmeric material, precompressed foam sealant or foam backup rods, may be used. The sealing material keeps the traffic barrier 10 from directly contacting the retaining wall 88.

In assembly, the traffic barrier 10 is aligned over the retaining wall 88 with reinforcing rods 58, 66 forming alternating eyelets 64 and 68 in the longitudinal channel 36. Sealing material 48 and 50 is put in place on the wall surface. The traffic barrier 10 is then lowered onto the sealing material 48 and 50 to form a seal between the traffic barrier 10 and the retaining wall 88 to minimize the possibility of grout escaping the channel. A locking beam is then inserted through the loops. The traffic barrier 10 is thus locked to the retaining wall 88. Then, a cast-in-place concrete, grout, mortar or similar material mixture is pumped through the inlet holes 72 into the channel 36. The openings at either end of the channel 36 allow the expulsion of air from the channel 36 while the cast-in-place concrete, grout, mortar or similar material mixture is pumped into the channel 36 allowing the channel to be completely filled with the mixture. It should be noted that once the concrete hardens, the strength of the joint formed by the anchoring eyelets is increased. After the concrete hardens the roadway surface 90 is built up in the conventional fashion.

Figure 2:
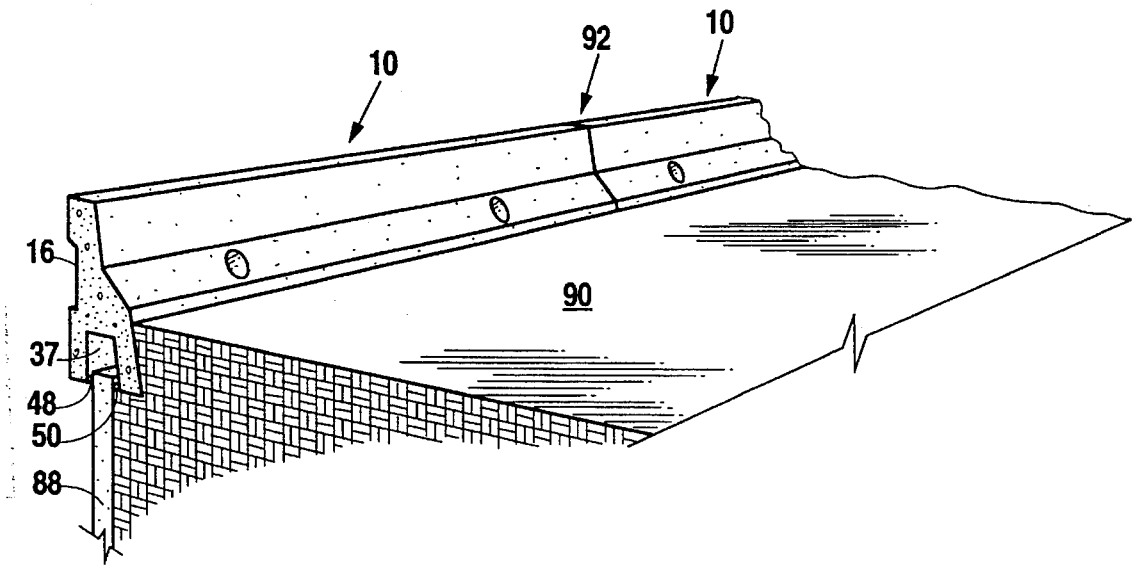
FIG. 2 is a perspective view of a roadway adjacent to a retaining wall wherein the wall barrier of FIG. 1 is safely engaged thereon.

With reference to FIG. 2, a plurality of precast traffic barrier elements 10 are supported on a retaining wall 88 to form a traffic barrier 92. Each traffic barrier element 10 has a length of 10 feet but can vary from 4 feet to 40 feet depending on the specific requirements of the roadway 90 and retaining wall 88. A roadway 90 is supported by frictionally stabilized earth 94. The outer surface 16 of the traffic barrier 10 is for ornamental purposes and could be left plain or decorated with different architectural designs. The precast traffic barrier 92 restrains a moving vehicle on an elevated traffic surface 90 from travelling over the edge of the wall face of the earth 94.

Figure 3:
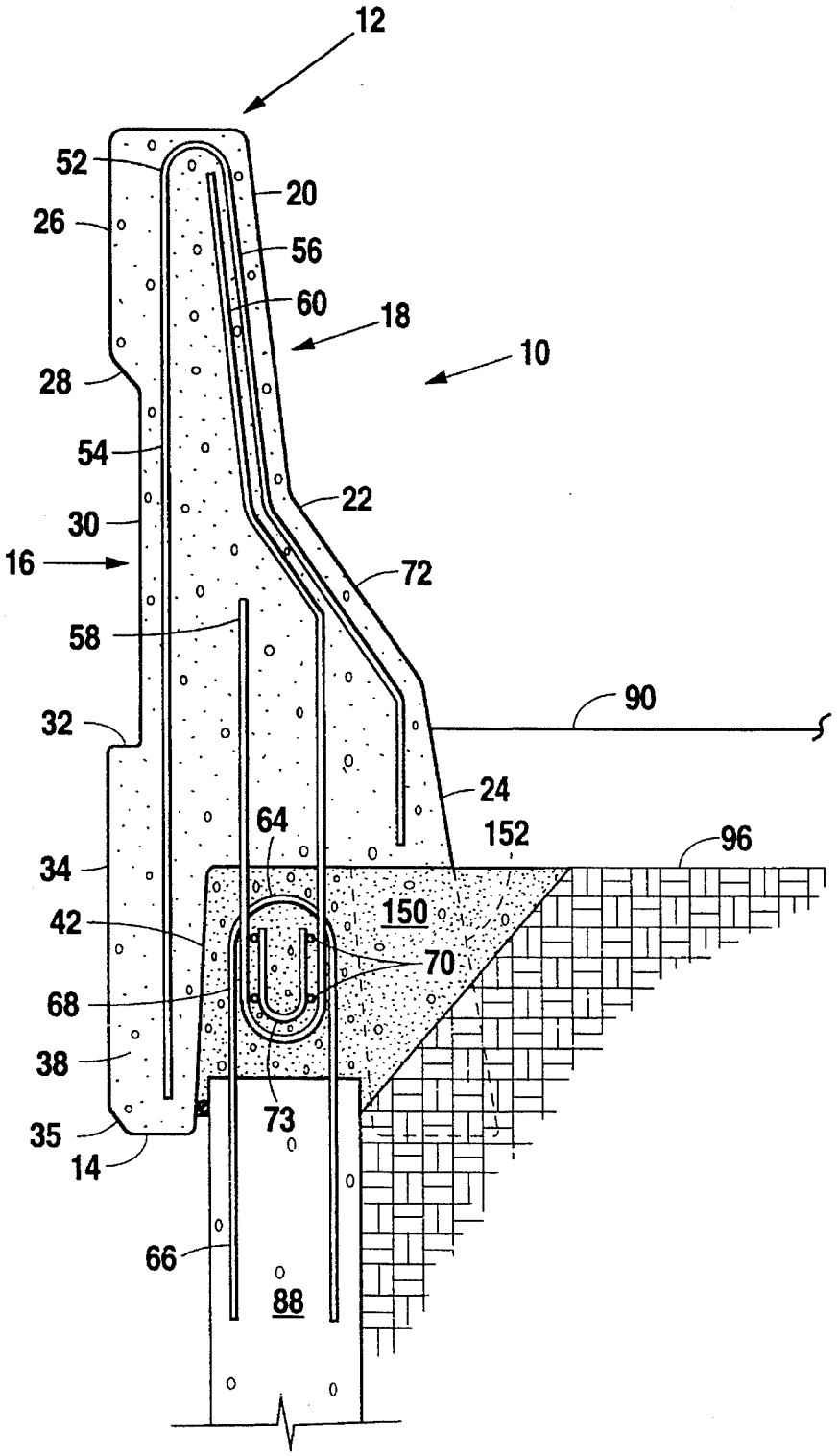
FIG. 3 is a cross-sectional view similar to FIG. 1 showing a further embodiment of a precast concrete barrier element.

With reference to FIG. 3, another embodiment of the precast traffic barrier 10 is cast with a longitudinal slot 150 and legs 152. Embedded in the precast traffic barrier 10 is reinforcing welded wire fabric 52 to resist directly applied stresses to the precast concrete traffic barrier 10. The welded wire fabric 52 has an outer vertical section 54 embedded within the concrete adjacent to the unprofiled side 16 and an inner section 56 embedded within the concrete adjacent to the profiled side 18. The inner section 56 follows the slopes of the profiled side's 18 upper inclined surface 20, intermediate inclined surface 22, and part of the lower inclined surface 24.

Figure 4:
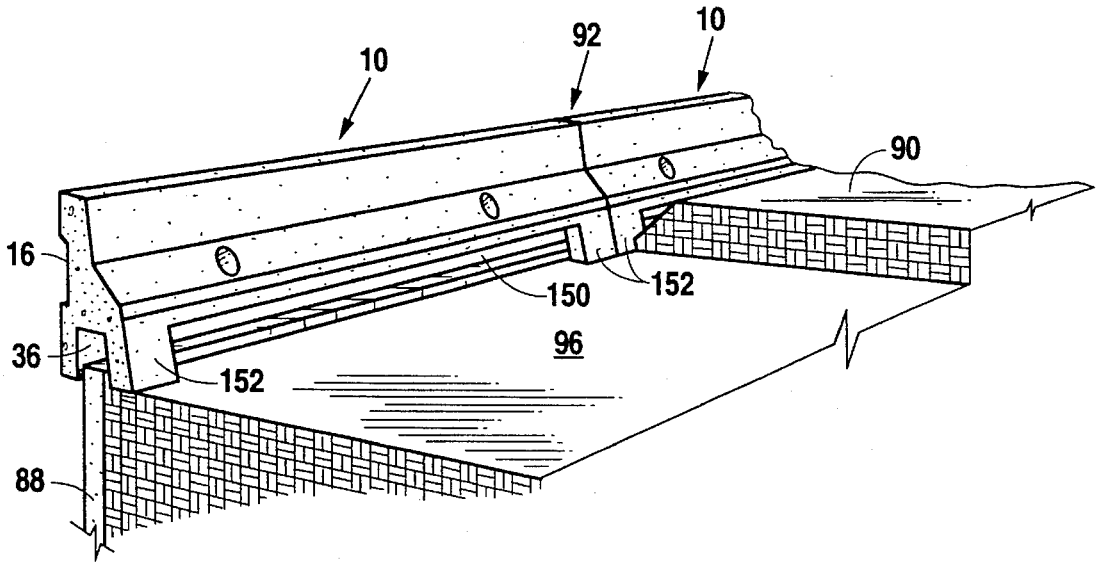
FIG. 4 is a perspective view of a roadway, with part of the roadway material removed, supported by a retaining wall having a precast concrete traffic barrier embodiment as illustrated in FIG. 3.

With reference to FIG. 4, a plurality of precast traffic barrier elements 10 are supported on a retaining wall 88 to form a traffic barrier 92. The roadway surface 90 is shown partially removed 96 to reveal the longitudinal slot 150. The slot 150 allows the cast-in-place concrete, grout, mortar or similar material to be pumped directly to the channel 36 encasing the interlocking anchor rods 58, 66 and locking welded wire fabric 68 of FIG. 3 without the need for air outlet holes. The legs 152 contain the cast-in-place concrete, grout, mortar or similar material in the channel 36 during pumping operations. The legs 152 also balance the traffic barrier 10 during construction, keeping the traffic barrier 10 from tipping over towards the roadway surface 90.

In operation, the traffic barrier 10 is aligned over the retaining wall 88 with reinforcing rods 58, 66 forming a closed oval 64 in the longitudinal channel 36. Sealing material 48, 50 is placed over the retaining wall 88. The traffic barrier 10 is then lowered onto the scaling material 48, 50 forming a seal between the traffic barrier 10 and the retaining wall 88. A locking U-shaped welded wire fabric 68 is then inserted through the closed loop 64. The traffic barrier 10 is thus locked to the retaining wall 88 by the U-shaped welded wire fabric 68. A cast-in-place concrete, grout, mortar or similar material mixture is pumped through the entire length of the longitudinal slot 150 into the channel 36.

The longitudinal slot 150 and openings at either end allow the expulsion of air from the channel 36 while the cast-in-place concrete, grout, mortar or similar material mixture is pumped into the channel 36 allowing the channel to be completely filled with the mixture. It should be noted that once the cast-in-place concrete, grout, mortar or similar material mixture hardens the strength of the joint formed by the anchoring bars 58, 66 and locking welded wire fabric 68 is increased. After the cast-in-place concrete, grout, mortar or similar material mixture hardens the roadway surface 90 is built up to a point at the top of the lower inclined surface 24.

Figure 5:
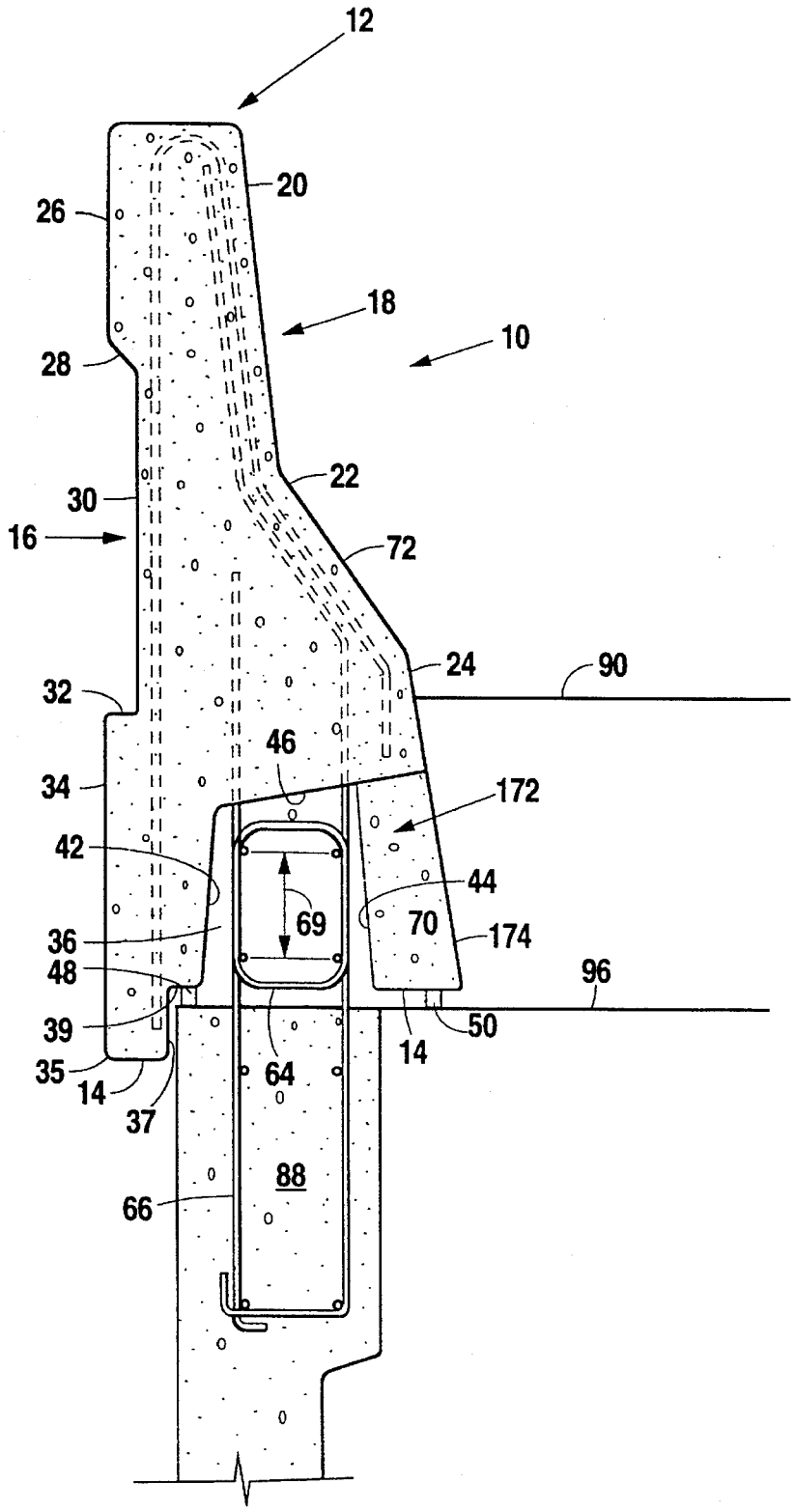
FIG. 5 is a cross-sectional view of another embodiment of a precast concrete barrier element.

With reference to FIG. 5, another embodiment of the precast traffic barrier 10 is cast with the chamfer surface 35 extending between the lower vertical surface 34 and the bottom surface 14. The bottom surface 14 extends from the chamfer surface 35 to an inner vertical surface 37. The inner vertical surface 37 slopes upwardly at a vertical angle to a shoulder 39. The inner vertical surface 37 extends for a length e of 3 inches, but this length e may vary from 1 inch to 24 inches. The greater the length e, the greater camming effect is created which counteracts any force applied which tends to tip the traffic barrier 10 over the retaining wall 88. Also, the length e can be increased to allow more adjustment when aligning each barrier element 10 with the adjacent barrier elements and to compensate for any unlevelness of the wall.

The shoulder 39 slopes at a horizontal angle to the sidewall 42 of the longitudinal channel 36. The sidewall 42 slopes upwardly to an internal face 46. The internal face 46 slopes upwardly at an angle of approximately 10 degrees but can vary from 0 degrees to 70 degrees. The internal face 46 extends from sidewall 42 to sidewall 44. The sidewall 44 slopes downwardly from the internal face 46 to the bottom surface 14. The length of sidewall 44 from the inner face 46 to the bottom surface 14 is less than the length of sidewall 42 from the inner face 46 to the bottom surface 14. Sidewall 44 is shown being 4 inches longer than sidewall 42, but sidewall 44 can be east to be from 1 inch to 36 inches longer than sidewall 42.

The longitudinal channel 36 of the precast traffic barrier 10 has an upper U-shaped reinforcing anchoring rod 58 extending into the longitudinal channel 36 to form a closed oval 64 with a lower U-shaped reinforcing anchoring rod 66. Reinforcing rods 69 for interlocking the upper U-shaped anchoring rod 58 with the lower U-shaped anchoring rod 66 are inserted through the oval 64 the length of the longitudinal channel 36 to transfer stresses from the precast concrete traffic barrier 10 to the retaining wall 88. The reinforcing rods 69 use 4 separate rods, one at each corner stress point of the oval 64, to transfer the stress, but can vary from 1 rod to 12 rods.

The sealing material 48, 50 supports the traffic barrier 10 and keeps the traffic barrier 10 from directly contacting the retaining wall 88. Sealing material 48 also prevents the pumped in cast-in-place concrete, grout, mortar or similar material from escaping from the longitudinal channel 36 down the retaining wall 88. The sealing material 48, 50 may also be used to shim a traffic barrier element 10 into alignment with adjacent traffic barrier elements.

Figure 6:
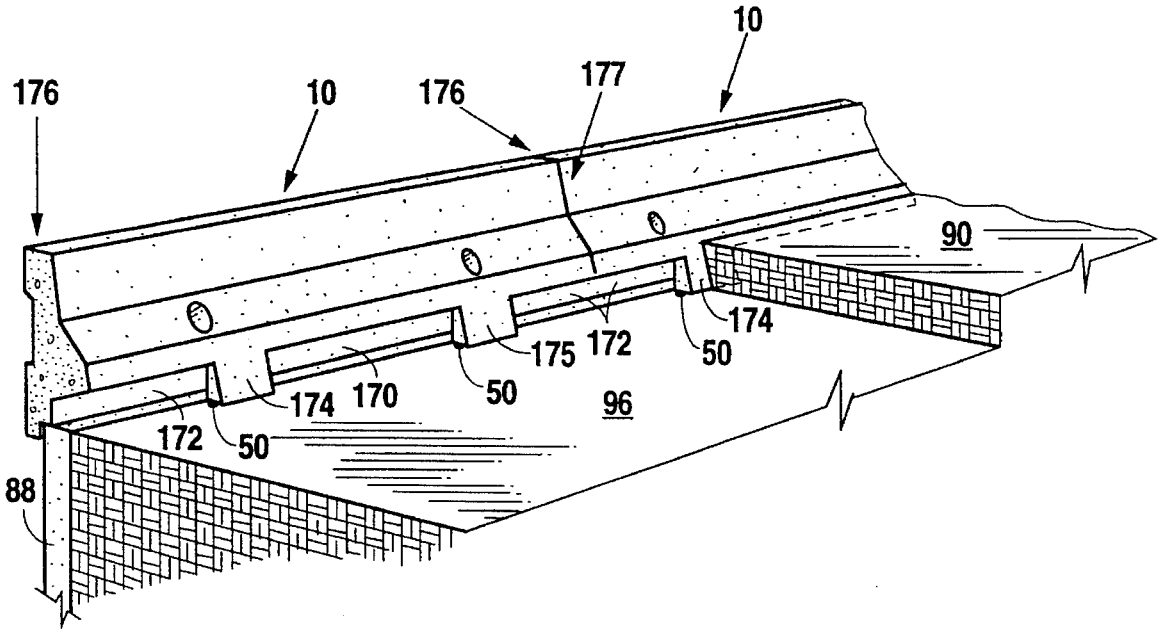
FIG. 6 is a perspective view of a roadway, with part of the roadway material removed, supported by a retaining wall having a precast concrete traffic barrier illustrated in FIG. 5.

With reference to FIG. 6, a plurality of precast traffic barrier elements 10 are supported on a retaining wall 88 to form a traffic barrier 92. The roadway surface 90 is shown partially removed 96 to reveal the legs 174. The legs 174, 175 are cast a distance of 2 feet 3¾ inches from the ends 176, 177 of the traffic barrier 10, but this distance can vary from 0 inches to 4 feet. This inset distance lessens the possibility that the legs 174, 175 will be damaged in storage or transportation to the construction site. The legs 174, 175 also balance the traffic barrier 10, keeping the traffic barrier from tipping over towards the graded roadway surface 91.

An inner longitudinal slot 170 extends from end section 174 to end section 175. Outer longitudinal slots 172 extend from end 176 to end section 174 and from end 177 to end section 177. The longitudinal slots 170, 172 allow cast-in-place concrete, grout, mortar or similar material to be poured directly into the longitudinal channel 36.

Figure 7:
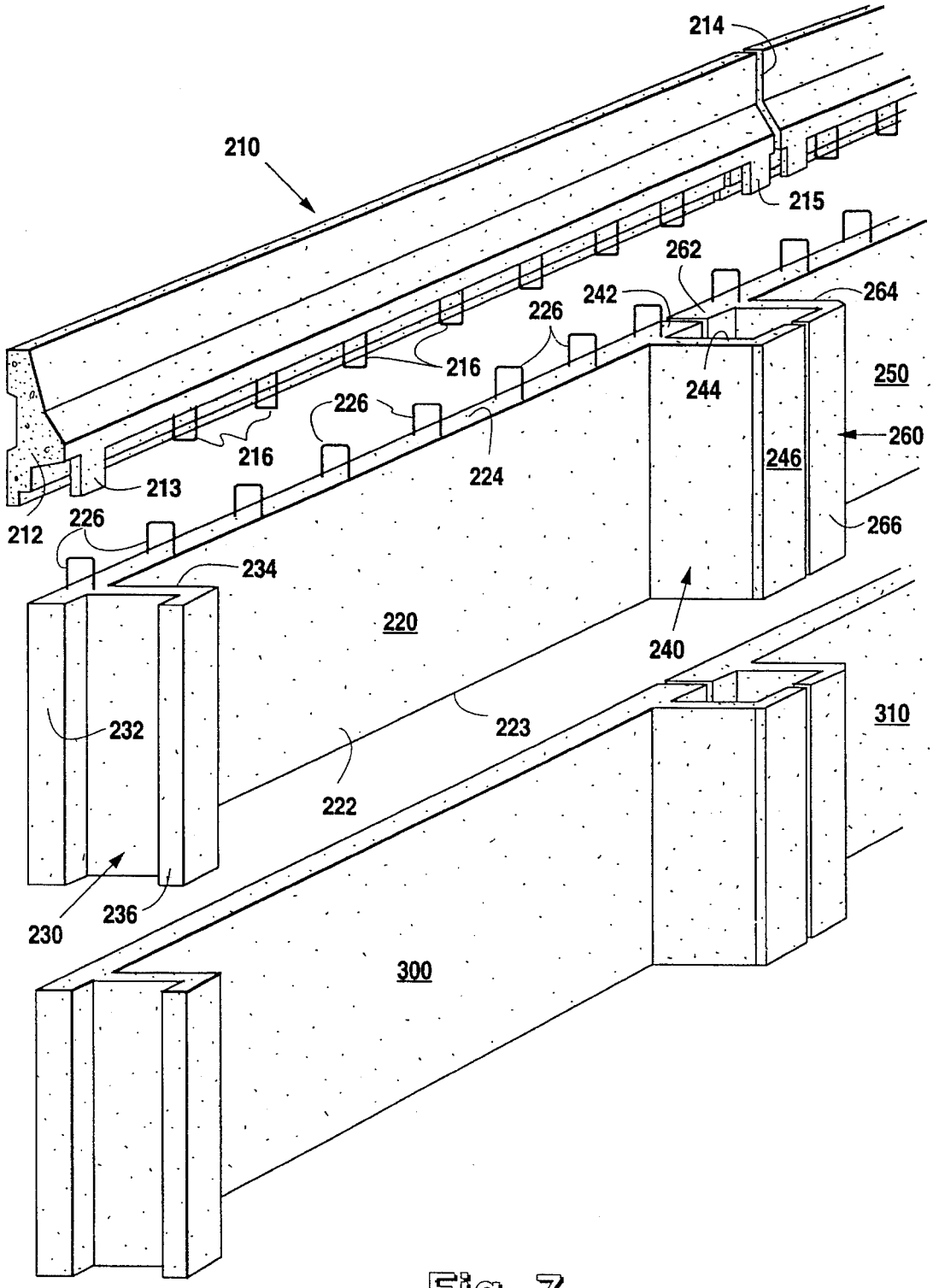
FIG. 7 is an expanded perspective view of a combination traffic barrier and C-shaped retaining wall constructed in accordance with this disclosure.

With reference to FIG. 7, another embodiment of the present invention is shown as a plurality of traffic barrier elements 210 in combination with a plurality of precast concrete, C-shaped retaining wall segments. The wall segments may also be post-tensioned. Precast traffic barrier element 210 has a plurality of spaced U-shaped anchoring rods 216 extending into the longitudinal channel of the barrier 210. The legs are 213, 215 are cast a distance of one foot from the ends 212, 214, but this distance can vary from 0 inches to 4 feet. This inset distance allows legs 213,215 to rest on U-shaped flanges 230, 240 of wall segment 220.

Each C-shaped retaining wall segment 220 has a vertically disposed panel 222, a bottom horizontal surface 223, a top horizontal surface 224, and vertically extending U-shaped flanges 230, 240. U-shaped flanges 230, 240 are horizontally disposed at opposite ends of the panel 222 and projecting rearwardly therefrom. Bottom horizontal surface 223 is adapted for direct contact with either the ground, foundation, or a stacked wall segment. Top surface 224 has a plurality of spaced U-shaped anchoring rods 226 extending therefrom.

Barrier element 210 and retaining wall segment 220 have a length of 10 feet, but can vary from 4 feet to 40 feet depending on the specific requirements of the job. In the preferred embodiment barrier element 210 and retaining wall segment 220 are the same length. Retaining wall segment 220 has a height of 10 feet, but can vary from 3 feet to 30 feet depending on the specific requirements of the job.

In the preferred embodiment, U-shaped anchoring rods 226 are entirely encased in wall segment 220 with panel 222 having a uniform thickness. Alternatively, panel 222 may be cast with a thicker portion near top surface 224 with the rods 226 protruding from the thicker portion. Panel 222 may also be cast so that one side of rods 226 exit from the top surface and the other side exits from the panel 222.

U-shaped flange 230 has a bottom 234 and two sides 232, 236. U-shaped flange 240 has a bottom 244 and two sides 242, 246. If the retaining wall is to be in a straight line, then the U-shaped flanges are precast with the sides 232, 236 having the same length. If the retaining wall requires a curvature, then U-shaped flanges 230, 240 may be precast with their sides having different lengths as shown in FIG. 4. Some curvature is possible in the retaining wall during construction by placement adjustments or by adding inserts 112 as illustrated in FIGS. 3 and 5, respectively.

Panel 222 may be designed to meet the specific load requirements of its use. The amount and strength of the embedded grid of vertical and horizontal reinforcement bars (not shown) may be varied. The thickness of panel 222 may also be varied to meet specific requirements. If panel 222 is to be used as a traffic barrier or in the bottom row of stacked panels then the barrier may be precast with a thickness of four inches to one hundred twenty-four inches, although in the preferred embodiment it will be eight inches thick with three quarters of an inch of exposed aggregate or other required surface material on the exposed face of the panel 222.

The panel is stable and self-supporting due to U-shaped flanges 230, 240. When viewed from above wall segment 220 has a C-shaped configuration. The C-shape of wall segment 220 allows easier and quicker construction of a retaining wall because the contractor can stand upright a plurality of segments onsite in preparation for placement in the retaining wall. The wall segments will then be easily and quickly moved into place and stacked upon one another. The faster construction process allows the contractor to save on the cost of labor and materials. An inventive aspect of the preferred embodiment is that wall segment 220 is capable of being a free standing structure that relies on no other means of support other than that derived from its own stability.

Figure 8:
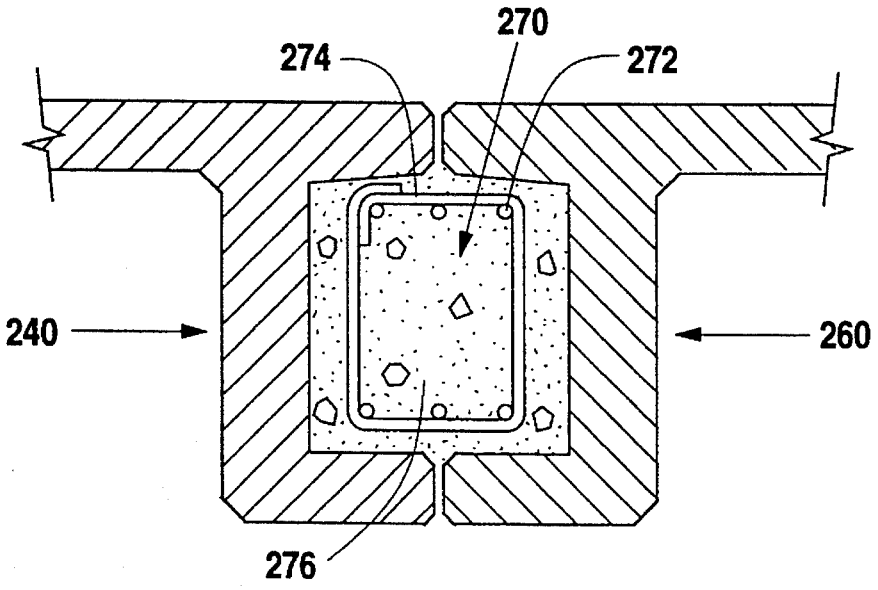
FIG. 8 is a top plan view of a column and retaining wall as illustrated in FIG. 7.

The construction time is also reduced because when wall segments 220, 250 are placed adjacent to one another, as shown in FIG. 8, their respective U-shaped flanges 240, 260 define four faces of a stay-in-place form for a structural column 270. Reinforcing rods 272 are attached to a drill pier in the foundation (not shown) and extend upwards a sufficient height to reinforce the column 270 and retaining wall. Reinforcing material 274 may also be added to the column 270 for more reinforcement of the column 270. Cast-in-place concrete 276 is poured into the stay-in-place form encasing the reinforcing rods and material creating structural column 270. The hardened concrete 276 and rods 272 couple column 270 to the drill pier.

Another inventive aspect of the preferred embodiment is that column 270 ensures proper alignment with between wall segments. This eliminates a common problem found in current column and panel walls. Current walls have imprecise lateral placement of panels due to accumulated variances in the panels and placement of the columns. Much construction time is wasted as contractors have to modify or add material to the panels or columns to obtain proper placement. If the placement is bad enough, then the columns may have to be re-built.

To support column 270 in its vertically upstanding position, any one of a multitude of suitable conventional supports may be used which would allow a round cage to extend from the support through the column. It is expected that either a drill shaft, a drill pier, cast-in-place spread footing, a caisson, or a steel piling encased in concrete may be used. If the ground underneath column 130 is hard and stable, then a ground anchor could even be used.

Figure 9:
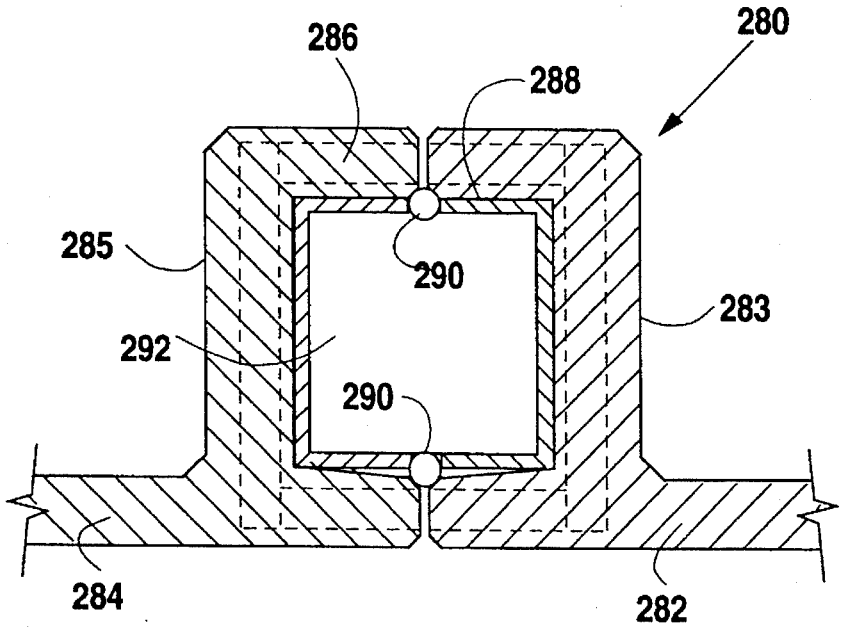
FIG. 9 is a top plan view of an expansion joint column for a column and retaining wall of FIG. 7.

Thermally induced expansion and contraction of wall segment 220 may lead to cracking of the panel 222 unless some arrangement is established to relieve thermally induced expansions and contractions. Cracking can also be created by external forces applied to the barrier, such as wind forces, impact forces from vehicles, lifting or sinking forces from ground swell or collapse, and the like. The present invention uses an expansion joint column as illustrated in FIG. 9 as one method of relieving the thermally induced internal forces and external forces.

Expansion joint column 280 is formed by wall segment 282 being placed adjacent to wall segment 284. U-shaped flanges 283,285 are placed adjacent to each other and over a drill pier or other support (not shown) and define the four faces of the stay-in-place form for expansion joint 280. Sufficient reinforcing steel (not shown) is inserted in the stay-in-place form to meet the design specifications. Cushioning material 286 is placed between U-shaped flanges 283, 285 and the support. Padding material 288 is placed on the inside of the stay-in-place form. Any material with sufficient padding and cushioning properties could be used as material 286,288. However, in the preferred embodiment neoprene is used as cushioning material 286 and fiberboard is used as padding material 288. Chamfers 290 are placed between U-shaped flanges 283, 285. Cast-in-place concrete 292 is then pour into the stay-in-place form. Depending on the expected internal and external forces expansion joint column 280 could be used in place of column 270. In most situations, expansion joint column will be used approximately every 100 feet of the retaining wall to provide for sufficient expansion and contraction of the barrier without cracking.

To assemble the combination traffic barrier and C-shaped retaining wall precast barrier elements and precast wall segments are transported to the job site and placed in the vicinity of their final placement in the combination traffic barrier and retaining wall.

A foundation is constructed for supporting the retaining wall with a plurality of drill piers of sufficient depth for withstanding expected overturning and destructive forces which may be applied to the retaining wall. The drill piers should be substantially aligned with adjacent drill piers having a distance separating them which is substantially the same distance as the length of a wall segment. Reinforcing material is placed through said drill pier extending upwards a sufficient height for reinforcing the retaining wall.

Grading of the traffic surface level with the top surface of the retaining wall structure may be done prior to positioning the barrier element over the retaining wall.

A first precast wall segment is positioned over the foundation so that it is aligned with a top surface of the foundation. Once aligned, the first precast wall segment is lowered so that the first precast wall segment engages the top surface of the foundation by lengthwise contact thereagainst in a stacked relationship. The bottom surface and U-shaped flanges of the first precast wall segment support the wall segment in an upright position.

A second precast wall segment is placed adjacent to the first precast wall segment so that the U-shaped flange of the second precast wall segment is removably coupled with the U-shaped flange of the first precast wall segment and defining the four faces of a stay-in-place form. The form surrounds the reinforcing material extending upward from the drill pier.

Cast-in-place concrete is poured into the stay-in-place form filling the drill pier and encasing the reinforcing material.

Sealing material may be placed on the top surface of the retaining wall segments and adapted to receive the second sidewall of the barrier element.

A barrier element is then aligned over the top surface of the retaining wall segment so that the longitudinal channel is aligned with the top surface of the retaining wall segment.

The barrier element is lowered so that the second sidewall facially engages the cooperative top surface of the retaining wall segment by lengthwise contact thereagainst in a stacked relationship. The legs of the barrier facially engaging the bottom of the U-shaped flanges by contact thereagainst in a stacked relationship. The traffic barrier is supported by the second sidewall and legs stacked on the U-shaped flanges.

Coupling of the barrier element with the retaining wall segments is accomplished by inserting an elongate locking rod through first eyelet means and the second eyelet means of the barrier element and wall segment. Cast-in-place concrete is then poured through the longitudinal slot to within the longitudinally extending channel encasing the first eyelet means, the second eyelet means, and the elongate rod.

If required, the traffic surface can be built up to a point at the top of the legs of the barrier.

Although the invention has been described with reference to specific embodiments, this description is not meant to be construed in a limiting sense. Various modifications of the disclosed embodiments, as well as alternative embodiments of the invention, will become apparent to persons skilled in the art upon reference to the description of the invention. It is therefore contemplated that the appended claims will cover such modifications that fall within the true scope of the invention.

I claim:

1. A combination traffic barrier and retaining wall for use adjacent a roadway comprising:

a. a barrier formed of at least two similar, end aligned barrier segments, each of said barrier segments including:

i. a traffic facing sidewall having a longitudinal slot defined by a pair of legs;

ii. a longitudinal channel along a nether face; and iii. a second and opposite sidewall;

b. a retaining wall of a least two similar, end aligned wall segments, each of said wall segments including:

i. a vertically disposed panel with an inner and outer face;

ii. a pair of vertically disposed U-shaped flanges, said U-shaped flanges horizontally disposed at opposite ends of said panel and projecting rearwardly therefrom; and iii. a cooperative top surface of said retaining wall facially engaging said barrier by lengthwise contact thereagainst in a stacked relationship;

c. said legs of said barrier segments being positioned in from each end of said barrier segments to facially engage said U-shaped flanges of said panel;

d. spaced first eyelet means supported by said barrier;

e. spaced second eyelet means supported by said retaining wall;

f. said first and second eyelet means aligning cooperatively and forming an oval locking relationship with said barrier and said top surface of said retaining wall;

g. an elongate rod serially threaded through all of said eyelet means; and h. cast-in-place concrete filling said longitudinal channel and said longitudinal slot.

2. The combination traffic barrier and retaining wall of claim 1 wherein a. said first eyelet means being a plurality of first U-shaped coupling members extending from said barrier to within said longitudinal channel;

b. said second eyelet means being a plurality of second U-shaped coupling members extending from said retaining wall to within said longitudinal channel; and c. said cast-in-place concrete encasing said plurality of first U-shaped coupling members, said plurality of second U-shaped coupling members, and said elongate rod.

3. The combination traffic barrier and retaining wall of claim 1 wherein said traffic facing sidewall has a cross-sectional profile for redirecting an incident vehicle toward said roadway and said outer face of said retaining wall has exposed aggregate.

4. The combination traffic barrier and retaining wall of claim 1 wherein said second sidewall has a shoulder adapted for engaging said top surface of said retaining wall by lengthwise contact thereagainst in said stacked relationship.

5. The combination traffic barrier and retaining wall of claim 1 wherein said longitudinal channel has an upwardly sloping upper face to facilitate the expulsion of air from said longitudinal channel when concrete is being poured through said longitudinal slot into said longitudinal channel.

6. A method of constructing a precast concrete traffic barrier in combination with a precast retaining wall structure adjacent a traffic surface wherein said precast concrete traffic barrier is comprised of a traffic facing sidewall having a longitudinal slot defined by a pair of spaced legs, a longitudinal channel along a nether face, and a second and opposite sidewall, spaced first eyelet means supported by said barrier element, and wherein said precast retaining wall is comprised of at least two similar, end aligned precast wall segments, said retaining wall having a relatively flat vertical outer face, each of said wall segments comprised of a vertically disposed panel with an inner and outer face, said outer face being a relatively flat surface, a pair of vertically disposed U-shaped flanges, said U-shaped flanges horizontally disposed at opposite ends of said panel and projecting rearwardly therefrom, said U-shaped flanges having a bottom and two sides, said U-shaped flanges capable of overcoming overturning forces exerted on said panel, a cooperative top surface of said retaining wall, and said pair of spaced legs of said traffic barrier are adapted to facially engage said U-shaped flanges of said retaining wall, wherein said method of construction comprises the steps of:

a. constructing foundation means for supporting said retaining wall in the direction of said retaining wall;

b. drilling a plurality of drill piers to a sufficient depth for withstanding expected overturning and destructive forces which may be applied to said retaining wall, said drill piers substantially aligned with adjacent drill piers having a distance separating said drill piers which is substantially the same distance as the length of said precast wall segment;

c. attaching reinforcing material to said drill pier and extending upwards a sufficient height for reinforcing said retaining wall;

d. transporting said precast barrier elements and said precast wall segments to the job site and placing said precast barrier elements and said precast wall segments in the vicinity of their final placement in said combination traffic barrier and retaining wall;

e. positioning a first precast wall segment over said foundation means so that said first precast wall segment is aligned with a top surface of said foundation means;

f. lowering said first precast wall segment so that said first precast wall segment engages said top surface of said foundation means by lengthwise contact thereagainst in a stacked relationship, said bottom surface and said U-shaped flanges of said first precast wall segment supporting said precast wall segment in an upright position;

g. placing a second precast wall segment adjacent to said first precast wall segment so that said U-shaped flange of said second precast wall segment is removably coupled with said U-shaped flange of said first precast wall segment and defining four faces of a stay-in-place form surrounding said reinforcing material extending upward from said drill pier, and so that said outer faces of said wall segments form said relatively flat vertical outer face of said retaining wall;

h. pouring cast-in-place concrete into said stay-in-place form filling said drill pier and encasing said reinforcing material;

i. placing sealing material on said top surface of said retaining wall segments and adapted to receive said second sidewall of said barrier element;

j. positioning said barrier element over said top surface of said retaining wall segment so that said longitudinal channel is aligned with said top surface of said retaining wall segment, said top surface having spaced second eyelet means;

k. lowering said barrier element so that said second sidewall facially engages said cooperative top surface of said retaining wall segment by lengthwise contact thereagainst in a stacked relationship, said legs of said barrier facially engaging said bottom of said U-shaped flanges by contact thereagainst in a stacked relationship, and said second sidewall and said legs supporting said traffic barrier's weight;

l. coupling said barrier element and said retaining wall segments by inserting an elongate locking rod through said first eyelet means and said second eyelet means;

m. pouring cast-in-place concrete through said longitudinal slot to within said longitudinally extending channel encasing said first eyelet means, said second eyelet means, and said elongate rod; and n. building up said traffic surface to a point at the top of said legs.

7. The method of claim 6 further comprising the step of grading of said traffic surface level with said top surface of said retaining wall structure prior to positioning said barrier element over said retaining wall structure.

8. The method of claim 7 further comprising the step of placing a plurality of precast wall segments to form a first row of precast wall segments prior to pouring cast-in-place concrete in said stay-in-place form.

9. The method of claim 8 further comprising the step of placing a plurality of precast wall segments forming a second row of precast wall segments on top of said first row of precast wall segments before pouring cast-in-place concrete in said stay-in-place form.

10. The method of claim 9 further comprising the step of placing a plurality of said barrier elements on said retaining wall structure.

11. The method of claim 10 wherein the step of coupling said barrier element to said retaining wall structure includes coupling a plurality of barrier elements to said retaining wall structure.

12. A precast concrete wall comprising a plurality of C-shaped retaining wall segments wherein said C-shaped retaining wall segments are capable of being varied in height, width or length, but having a generally similar C-shaped cross-section, each C-shaped retaining wall segment comprising:

a. a vertically arranged precast concrete panel having a thickness, a height, and a first generally vertical edge and a second generally vertical edge;

b. a first generally vertically disposed U-shaped member and a second generally vertically disposed U-shaped member, each said first and said second U-shaped member having a front leg and a rear leg, and a thickness and a height substantially similar to said thickness and said height of said panel, each said first and second U-shaped members horizontally located at opposite ends of said panel;

c. said panel located in a horizontal plane from said front leg of said first U-shaped member to said front leg of said second U-shaped member;

d. said first U-shaped member, said second U-shaped member, and said panel capable of overcoming ambient overturning forces exerted on said panel whereby said precast C-shaped retaining wall segment is inherently stable and capable of standing upright with no other support.

* * * * *